US007214458B2

(12) United States Patent
Mang et al.

(10) Patent No.: US 7,214,458 B2
(45) Date of Patent: May 8, 2007

(54) TONER COMPOSITIONS

(75) Inventors: Mark E. Mang, Rochester, NY (US); Hui Chang, Pittsford, NY (US); D. Paul Casalmir, Sodus, NY (US)

(73) Assignee: Xerox Corporation, Stamford, CT (US)

( * ) Notice: Subject to any disclaimer, the term of this patent is extended or adjusted under 35 U.S.C. 154(b) by 320 days.

(21) Appl. No.: 10/650,553

(22) Filed: Aug. 28, 2003

(65) Prior Publication Data

US 2005/0064311 A1 Mar. 24, 2005

(51) Int. Cl.
*G03G 9/08* (2006.01)

(52) U.S. Cl. ..... 430/108.1; 430/109.3; 430/109.4; 430/124; 430/136

(58) Field of Classification Search ..... 430/108.1, 430/109.3, 109.4, 124, 136
See application file for complete search history.

(56) References Cited

U.S. PATENT DOCUMENTS 3,635,704 A 1/1972 Palermiti et al. ..... 96/1
3,655,374 A 4/1972 Palermiti et al. ..... 96/1.4
3,965,021 A 6/1976 Clemens et al. ..... 252/62.1 P
3,983,045 A 9/1976 Jugle et al. ..... 252/62.1 P
4,367,275 A 1/1983 Aoki et al. ..... 430/99
4,557,991 A 12/1985 Takagiwa et al. ..... 430/109
4,795,689 A 1/1989 Matsubara et al. ..... 430/99
4,917,982 A 4/1990 Tomono et al. ..... 430/99
4,921,771 A 5/1990 Tomono et al. ..... 430/110
4,988,598 A 1/1991 Tomono et al. ..... 430/99
4,997,739 A 3/1991 Tomono et al. ..... 430/110
5,004,666 A 4/1991 Tomono et al. ..... 430/110
5,023,158 A 6/1991 Tomono et al. ..... 430/99
5,229,242 A 7/1993 Mahabadi et al. ..... 430/106.6
5,972,547 A 10/1999 Yaguchi et al. ..... 430/45
6,475,690 B2 * 11/2002 Anno et al. ..... 430/108.8
6,538,063 B1 * 3/2003 Hikosaka et al. ..... 525/54.44

* cited by examiner

*Primary Examiner*—John L Goodrow
(74) *Attorney, Agent, or Firm*—Eugene O. Palazzo; Fay Sharpe, LLP

(57) ABSTRACT

A toner that contains resin, colorant, wax and an aromatic hydrocarbon compatibilizer.

43 Claims, No Drawings

TONER COMPOSITIONS

BACKGROUND

Disclosed generally are toner and developer compositions, and more specifically, toner compositions, including magnetic, single component, two component and colored toner compositions containing a compatibilizer which can also function as an embrittling agent and a least one wax component, and wherein the embrittling agent can increase the toner components pulverizing rate up to about 84 percent higher than a number of current production toner rates to thereby reduce manufacturing costs. A compatibilizer, for example, allows the wax phase to be substantially fully dispersed in the resin phase; when the wax is not well dispersed in the toner it is removed during processing and contained in the final product and is not available to fully serve its release function in the fusing subsystem. In embodiments, the toner compositions can contain a polymer, a colorant, a wax, a wax compatibilizer/embrittling agent, toner additives, such as charge enhancing additives, surface additives, and the like, and also the toner can contain two polymers, and in embodiments from about 2 to about 10 polymers comprised, for example, of a first resin, a second crosslinked resin, a wax component, and a compatibilizer component. In embodiments, the toner compositions are comprised of resin particles, including first resin and second crosslinked resin particles, colorant, such as pigment particles, a wax component, such as polyolefins like polypropylene wax, polyethylene wax, and mixtures thereof, and a compatibilizer, such as a copolymer, homopolymer, aromatic copolymers, and more specifically, polymers available from Mitsui Chemicals as FTR Series, like FTR-1625F, and the FMR series, like FMR-0150, and which polymers are, for example, methyl styrene homopolymers, methyl styrene copolymers, polymers containing an aromatic monomer and a methyl styrene copolymer, polymers containing an aromatic pure monomer and a methyl styrene aliphatic copolymer, aromatic pure polymers, aromatic pure monomer/aromatic monomer copolymers, and the like, all available from Mitsui Chemicals as the grade zero series, the 2,000 series, the 6,000 series, the 7,000 series, the 8,000 series, FMR series and the FTR series. More specifically, the compatibilizers that can be selected for the toners of the present invention are illustrated in U.S. Pat. No. 5,927,547, the disclosure of which is totally incorporated herein by reference.

There are also provided in accordance with the present disclosure positively or negatively charged toner compositions comprised of resin particles, colorant particles, a wax component, such as a low molecular weight polyethylene wax, a polypropylene wax, or mixtures thereof, a compatibilizer/embrittling agent as illustrated herein, charge enhancing additives and surface additives like colloidal silicas, metal oxides, and the like. In addition, there are illustrated herein developer compositions comprised of the aforementioned toners, and carrier particles. Furthermore, in embodiments of the present invention there are provided single component toner compositions comprised of resin particles, magnetic components, such as magnetites, a wax component, such as polypropylene wax, the compatibilizer component as illustrated herein, and optional known toner additives.

The disclosed toner and developer compositions are useful in a number of known electrostatographic imaging and printing systems, especially those systems wherein a wax is present in the toner, and wherein in embodiments the toners possess a wide fusing latitude, for example about 100° C., which is the temperature range between the minimum fixing temperature of, for example, from about 100° C. to about 170° C., usually selected for fixing toner particles on paper and the hot, for example, from about 180° C. to about 250° C. offset temperature. The developer compositions disclosed can provide toner images with low surface energy and a low frictional coefficient, which properties enable the effective release of paper from the fuser roll and provide for a reduction in image smudging. Further, the developer compositions possess stable electrical properties for extended time periods, and with these compositions, for example, there is no substantial change in the toner triboelectrical charging values.

REFERENCES

In U.S. Pat. No. 4,795,689, the disclosure of which is totally incorporated herein by reference, there is disclosed an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10, for example; U.S. Pat. No. 4,557,991, the disclosure of which is totally incorporated herein by reference, discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25; and as collateral interest U.S. Pat. No. 3,965,021, the disclosure of which is totally incorporated herein by reference.

Developer and toner compositions with certain waxes therein, which waxes can be selected as a component for the toners disclosed are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 15,000 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$ of from about 200 to about 6,000) to improve hot offset. Examples of waxes include, for example, alkylenes, such as polypropylene, polyethylene, reference U.S. Pat. Nos. 5,023,158; 5,004,666; 4,988,598; 4,921,771; and 4,917,982; of which are totally incorporated herein by reference, and the like, and which waxes can be selected for the toners illustrated herein.

In addition, many patents disclose the use of metal salts of fatty acids for incorporation into toner compositions, such as U.S. Pat. No. 3,655,374, the disclosure of which is totally incorporated herein by reference. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045, the disclosure of which is totally incorporated herein by reference, three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275, the disclosure of which is totally incorporated herein by reference, are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45.

In U.S. Pat. No. 5,229,242, the disclosure of which is totally incorporated herein by reference, there is illustrated a toner composition comprised of first resin particles, second crosslinked resin particles, pigment, wax component particles, and a compatibilizer comprised of a graft copolymer, or a block copolymer; and wherein the compatibilizer is of the formula A-b-B, A-b-B-b-A or A-g-B wherein A-b-B is a block copolymer of 2 segments; A and B, A-b-B-b-A is a block copolymer of 3 segments; and A-g-B is a graft copolymer of segments A and B, and wherein the wax component is substantially retained in the toner composition.

However, there are various problems associated with the inclusion of polyolefin or other waxes in toners. For example, when a polypropylene wax is included in a toner to enhance the release of toner from a hot fuser roll, or to improve the lubrication of fixed toner image the wax may not disperse well in the toner resin. As a result, free wax particles are released during for example pulverization of the toner resin, and colorant, in for example, a fluid energy mill and also the pulverization rate can be lower than desired. The poor dispersion of wax in the toner resin and, therefore, the loss of wax will then impair the release function it is designed for. Scratch marks, for example, on xerographic developed toner solid areas caused by stripper fingers can be a result of poor release. Furthermore, the free wax remaining in the developer will build up on the detone roll present in the xerographic apparatus causing a hardware failure.

A number of the aforementioned problems and others can be eliminated, or minimized with the toner compositions and processes illustrated herein in embodiments thereof. The release of wax particles is, for example, a result of poor wax dispersion during the toner mechanical blending step. All additives should be dispersed well in the primary toner resin for them to impart their specific functions to the toner and thus the developer. For some of the additives, such as waxes like polypropylene, VISCOL 550P™, that become a separate molten phase during melt mixing, the difference in viscosity between the wax and the resin can be orders of magnitude apart, thus causing difficulty in reducing the wax phase domain size. A more fundamental reason for poor wax dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanically blending the toner formulation in certain types of mixers, such as the known Banbury mixer, where the temperature of melt can be maintained at a low level and polymer viscosities are not that far apart. However, it can be difficult to generate an effective wax dispersion in compounding extruders where melt temperatures are typically higher. The inclusion of a compatibilizer/embrittling agent disclosed herein is designed to substantially overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of a secondary polymer phase, such as wax, in the host resin against gross phase separation over time.

A number of specific advantages are associated with the toners disclosed in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by these free wax particles; avoiding/minimizing the pulverizing rate reduction resulting from the poor wax dispersion; maintaining the intended concentration of wax in the toner to provide enhancement during release from the fuser roll and avoiding the undesirable scratch marks caused by the stripper fingers; a wide process latitude can be provided during the mechanical blending operation of the toner manufacturing process; and enabling the effective mechanical blending of toner to be accomplished in a number of devices, including an extruder. In addition, the embrittling agent/compatibilizer enables an increase in the toner pulverizing rate.

SUMMARY

It is a feature of the disclosure to provide toner and developer compositions which possess many of the advantages illustrated herein.

Another feature of the disclosure resides in the provision of toner and developer compositions with stable triboelectrical characteristics for extended time periods.

In another feature of the disclosure there are provided toner and developer compositions that enable improved dispersion of resin and wax components achievable in a number of devices, including an extruder.

Moreover, another feature of the disclosure relates to the provision of toner and developer compositions with a compatibilizer and wherein for the resulting toners there is avoided, or there is minimized the undesirable generation of particles comprised of a secondary polymer component during toner preparation. These particles can impair the function for which the secondary polymer component is designed.

In a further feature of the disclosure the toner mechanical blending operation can be accomplished at a melt temperature as high as 50° C. above the melting point of the wax component, thus enabling the use of a large number of apparatuses in addition to a low melt temperature mixing process using equipment such as a Banbury mixer.

In yet another feature of the disclosure the secondary polymeric phases in the toner will remain stable and substantial phase separation, especially over extended time periods of, for example, up to six months in embodiments, will not take place.

Additionally, in yet another feature of the disclosure there are provided toner and developer compositions with certain waxes therein or thereon that enable images of excellent quality inclusive of acceptable resolutions, and that possess other advantages as illustrated herein such as low surface energy.

Another feature of the disclosure resides in the provision of a specific polymer embrittling component in a toner wherein incompatible polymers, including at least one wax component, are present, which polymer can possess distinct segments or blocks, each compatible with one of the toner resins or toner polymers selected, especially when two toner polymers are selected, one of which is a crosslinked polymer.

Yet another feature of the disclosure resides in toners and the provision of processes for the preparation of toner compositions wherein the undesirable escape of the wax contained therein is avoided or minimized.

Aspects illustrated herein include a toner comprised of resin, colorant, wax, and an aromatic hydrocarbon compatibilizer; a toner comprised of resin, colorant, and a compatibilizer of a copolymer generated from a styrene monomer and an indene monomer, and which compatibilizer contains

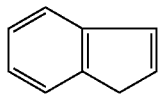

Indene

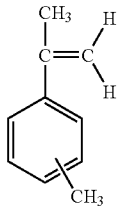

Isopropenyltoluene a toner comprised of resin, colorant, wax and a copolymer of isopropenyltoluene/indene, and which copolymer possesses a weight average molecular weight of from about 900 to about 7,000; a copolymer of isopropenyltoluene/indene, and which copolymer possesses a weight average molecular weight of from about 1,000 to about 4,000; a copolymer of isopropenyltoluene/indene, and which copolymer possesses a weight average molecular weight of from about 2,000 to about 6,000; and wherein the toner optionally further contains additives of silica oxide, titanium oxide and zinc stearate; toner compositions comprised of resin particles, pigment particles inclusive of magnetites, waxes, and a compatibilizer, which compatibilizer can also function as an embrittling component, and more specifically, which component is a polymer or copolymer of a styrene monomer and an indene based monomer; toner compositions comprised of first resin particles, second crosslinked resin particles, colorant particles, low molecular weight waxes, such as polyethylene, and polypropylene, such as those available from Sanyo Chemicals of Japan as VISCOL 550P™ and VISCOL 660P™ and the like, and the polymer compatibilizer illustrated herein; positively charged toner compositions comprised of resin particles, pigment particles, low molecular weight waxes, a compatibilizer and a charge enhancing additive; developer compositions comprised of the aforementioned toner; and carrier particles; developer compositions comprised of toner compositions containing first resin particles like a styrene butadiene resin, second crosslinked resins of, for example, a styrene methacrylate crosslinked with known components such as divinylbenzene, pigment particles such as magnetites, carbon blacks or mixtures thereof, low molecular weight waxes, such as polyethylene, and polypropylene, such as those available from Sanyo Chemicals of Japan as VISCOL 550P™ and VISCOL 660P™, the compatibilizer/embrittling agent illustrated herein or mixtures thereof, toner surface additives, and an optional charge enhancing additive, and carrier particles. As carrier components for the aforementioned compositions, there can be selected a number of known materials like steel, iron, or ferrite, particularly with a polymeric coating thereover.

Illustrative examples of suitable toner resins selected for the toner and developer compositions disclosed, and present in various effective amounts, such as, for example, from about 70 percent by weight to about 95 percent by weight, include styrene acrylates, styrene methacrylates, styrene butadienes, polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process reference, U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® and PLIOTONES® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol; extruded resins, such as those illustrated in U.S. Pat. Nos. 5,376,494; 5,401,602; 5,227,460 and 5,352,556. In embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin like styrene butadiene, and from about 50 to about 10, and preferably about 30 weight percent of the second resin like the resin crosslinked with, for example, divinylbenzene.

Numerous well known suitable pigments can be selected as the colorant for the toner particles including, for example, carbon black like REGAL 330®, BLACK PEARLS®, VULCAN®, and the like, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 2 percent by weight to about 20 percent by weight, and preferably from about 5 to about 10 weight percent, based on the total weight of the toner composition, however, lesser or greater amounts of pigment particles may be selected in embodiments.

When the colorant particles are comprised of known magnetites, including those commercially available as MAPICO BLACK®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

In a further disclosed embodiment there are provided colored toner compositions containing as pigments or colorants known magenta, cyan, and/or yellow particles, and mixtures thereof. More specifically, with regard to the generation of color images utilizing the toner and developer compositions disclosed, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Also, there may be selected red, green, blue, brown, and the like pigments. These pigments are generally present in the toner composition in an amount of from about 2 weight percent to about 15 weight percent, and preferably from about 2 to about 10 weight percent, based on the weight of the toner resin particles.

More specifically, colorants, such as dyes, pigments, and mixtures thereof present in the toner in an effective amount of, for example, from about 1 to about 25 percent by weight of the toner components, and more specifically, in an amount of from about 2 to about 12 weight percent, include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Mathesan, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2873 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Various known suitable effective positive or negative charge enhancing additives can be selected for incorporation into the toner compositions disclosed herein, more specifically in an amount of about 0.1 to about 10, and yet more specifically about 1 to about 3 percent by weight. Examples of the additives include quatemary ammonium compounds inclusive of alkyl pyridinium halides; alkyl pyridinium compounds, reference U.S. Pat. No. 4,298,672, the disclosure of which is totally Incorporated hereby by reference; organic sulfate and sulfonate compositions, U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

There can also be blended with the toner compositions disclosed herein toner additives, such as external additive particles including flow aid additives, which additives are usually present on the surface thereof. Examples of these additives include metal oxides like titanium oxide, tin oxide, mixtures thereof, and the like, colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, coated silicas, and U.S. Pat. No. 6,214,507, the disclosures which are totally incorporated herein by reference.

Examples of low molecular weight, for example from about 1,000 to about 20,000, and more specifically, from about 1,000 to about 7,000, waxes include those as illustrated in the British 1,442,835 patent publication and the appropriate US patents mentioned herein, the disclosures of which are totally incorporated herein by reference, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion usually possess a lower pulverizing rate and the free wax which can remain with the toner will build up on the internal parts of the xerographic cleaning device causing a machine failure. These and other disadvantages are avoided or minimized with the toners illustrated herein in embodiments thereof.

The compatibilizer may possess various properties including, but not limited to, softening point, glass transition temperature (Tg), weight average molecular weight ($M_w$), number average molecular weight ($M_n$), and dispersity, which is the ratio of $M_w/M_n$. The compatibilizer may possess a softening point of from about 80° C. to about 140° C. In one embodiment the compatibilizer possesses a softening point of from about 80° C. to about 100° C. In another embodiment, the compatibilizer possesses a softening point of from about 95° C. to about 140° C. In still another embodiment, the compatibilizer possesses a softening point of from about 100° C. to about 138° C. In yet a further embodiment, the compatibilizer possesses a softening point of from about 110° C. to about 125° C.

In various embodiments, the compatibilizer may possess a glass transition temperature (Tg) of from about 15° C. to about 75° C. In one embodiment, the compatibilizer possesses a glass transition temperature of from about 30° C. to about 60° C. In another embodiment, the compatibilizer possesses a glass transition temperature of from about 50° C. to about 65° C. In still another embodiment, the compatibilizer possesses a glass transition temperature of from about 30° C. to about 65° C.

The compatibilizer may also exhibit a range of weight average molecular weights ($M_w$). In one embodiment, for example, the compatibilizer possesses a weight average molecular weight of from about 800 to about 2,800. In another embodiment, the compatibilizer possesses a weight average molecular weight of from about 790 to about 2,760. And in a further embodiment, the compatibilizer possesses a weight average molecular weight of from about 1,200 to about 1,900.

The compatibilizer may also possess a number average molecular weight ($M_n$). In one embodiment, the compatibilizer possesses a number average molecular weight of from about 550 to about 1,600. In another embodiment, the compatibilizer possesses a number average molecular weight of from about 800 to about 1,100. In a further embodiment, the compatibilizer possesses a number average molecular weight of from about 920 to about 1,190.

Additionally, the compatibilizer may also exhibit or possess a dispersity, which is the ratio of weight average molecular weight to number average molecular weight, i.e. $M_w/M_n$. In one embodiment, the compatibilizer possesses a dispersity of from about 1 to about 2. In another embodiment the compatibilizer possesses a dispersity of from about 1.02 to about 1.83. And in yet another embodiment, a compatibilizer possesses a dispersity of from about 1.40 to about 1.70.

The compatibilizer which can be selected in various effective amounts, such as from about 1 to about 20, more specifically from about 2 to about 10 weight percent, yet more specifically from about 0.5 to about 8 weight percent or from about 1 to about 8 percent by weight, and which compatibilizer can also function as an embrittling agent, includes copolymers of isopropenyl toluene and indene (FMR-0150), copolymers of isopropenyl toluene and $C_5$ distillates (FTR-6125F), and the like, reference U.S. Pat. No. 5,972,547, the disclosure of which is totally incorporated herein by reference.

With further respect to the toner and developer compositions disclosed herein, a component that may be present therein is the linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in disclosed embodiment the polymeric alcohols selected possess a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Illustrative examples of carrier particles that can be selected for mixing with the disclosed toner compositions include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites, like copper zinc ferrites, available from Steward Chemicals, and the like. The carrier particles may include thereon known coatings like fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings. There can also be selected as carriers components comprised of a core with a mixture, especially two, polymer coatings thereover, reference U.S. Pat. Nos. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Although the diameter of the carrier particles can vary, generally they are of a diameter of from about 50 microns to about 1,000 microns, and preferably from about 75 to about 200 microns, thus allowing, for example, these particles to possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions disclosed can be prepared by a number of known methods, including mechanical blending and melt blending the toner resin particles, pigment particles or colorants, compatibilizer/embrittling agent, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized, and classified, thereby providing a toner with an average volume particle diameter of from about 7 to about 25, and preferably from about 10 to about 15 microns as determined by a Coulter Counter. The toner compositions can also be prepared in a compounding extruder such as a corotating intermeshing twin screw extruder of the type supplied by the Werner & Pfleiderer Company of Ramsey, N.J. The inclusion of compatibilizer enables, for example, improved thermodynamic compatibility between the primary and the secondary polymer phases. As a result, the secondary polymer can be dispersed into smaller domain particle size waxes with improved adhesion to the primary resin. The smaller domain size and the excellent adhesion to the primary toner resin will then prevent or minimize the secondary wax polymer from separating into individual particles during pulverization. Furthermore, the compatibilizing action can be functioning even at high melt temperatures, for example about 50° C. above the melting point of the wax component where mechanical blending is difficult because of a vast difference in polymer viscosity. This advantage increases the process latitude of the mechanical blending operation. The advantage of including a compatibilizer/embrittling agent may not be limited to the mechanical blending process alone; thus, for example, improved dispersion and adhesion can be realized in other known preparation methods. Also, high concentrations, such as up to, for example, 10 percent by weight, and more specifically, from about 5 to about 7 percent by weight of the wax, can be effectively dispersed in a toner by including an effective amount of compatibilizer/embrittling agent.

The toner and developer compositions disclosed may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, hydroxygallium phthalocyanines, perylenes, and vanadyl phthalocyanines, while examples of charge transport layers include the aryl amines as disclosed in U.S. Pat. No. 4,265,990, the disclosure of which is totally incorporated herein by reference.

The toner and developer compositions disclosed can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following examples are provided, wherein parts and percentages are by weight unless otherwise indicated. A comparative Example is also provided.

EXAMPLE I

A number of toner compositions comprised of about 80 to about 90 percent by weight of a partially crosslinked propoxylated bisphenol-A fumarate, LEX, (about 40 percent crosslinked and about 60 percent uncrosslinked) or a crosslinked polyester resin containing about 60 percent by weight of a linear polyester of propoxylated bisphenol A fumarate, and approximately 40 percent by weight of the crosslinked propoxylated bisphenol A fumarate, about 3 to about 7 percent by weight of polypropylene wax, $M_w$ of about 660 and available as VISCOL 660P™, from Sanyo Chemicals of Japan, 5 percent by weight of REGAL 330® carbon black, 0 to about 10 percent by weight of a compatibilizer/embrittling agent comprised of isopropenyltoluene/indene copolymer with a $M_w$ of about 2,040 and a $M_n$ of about 1,190 available from Mitsui Chemicals of Japan, were prepared by mechanically blending the aforementioned components using Werner & Pfleiderer ZSK25 and ZSK-40 twin screw extruders at barrel set temperatures of from about 130° C. to about 160° C. After pulverization and classification by known processes, toner particles with a volume average diameter of about 9 microns as measured by a Coulter Counter were obtained. The addition of the above compatibilizer yielded pulverizing rate increases of about 40 percent to about 80 percent. These grinding rate increases were measured from the feed rate of an Alpine AFG200 grinder; reference Table 1 for pulverizing rate increase data relative to a control toner of 87 percent by weight of a partially crosslinked propoxylated bisphenol A fumarate, LEX, a crosslinked polyester resin containing about 60 percent by weight of a linear polyester of propoxylated bisphenol A fumarate, and approximately 40 percent by weight of the crosslinked propoxylated bisphenol A fumarate, 5 percent by weight of the polypropylene wax, $M_w$ of about 660 and available as VISCOL 660P™, from Sanyo Chemicals of Japan, 5 percent by weight of REGAL 330® carbon black, 3 percent by weight of a wax compatibilizer comprised of ethylene-glycidyl methacrylate copolymer, AX-8840, available from Atofina Chemicals, Inc. of Philadelphia, Pa.

TABLE 1

Pulverizing Rate Increase

| % by weight Compatibilizer/Dispersant | Pulverizing Rate Increase |
|---|---|
| 3%* | 0 |
| 5 | 37 |
| 8 | 84.6 |

*Control Toner with the known AX8840

The generated wax dispersion was quantified, reference Table 2, by a wax dispersion index value. This value was obtained by measuring the wax content in the first pass classification fines via DSC and measuring the wax content of the final product via DSC. Fines are the small particles, <5 microns distribution, that were removed during the classification process. The final toner product particles were within the size distribution of 9+/−1 micron. The dispersion index refers to the difference between these two values divided by the sum of these two values.

TABLE 2

Wax Dispersion Values vs. FTR-6125F Concentration

| PERCENT 660P WAX BY WEIGHT | PERCENT FTR-6125F BY WEIGHT | WDI |
|---|---|---|
| 5 | 0 | 0.48 |
| 5 | 0 | 0.47 |
| 3 | 0 | 0.34 |
| 4 | 5 | 0.08 |
| 5 | 10 | 0.06 |
| 4 | 10 | 0.03 |
| 3 | 10 | 0 |

Large WDI numbers, such as the 0.34, 0.47, and 0.48 values shown in Table 2, indicate poor wax dispersion since a large portion of the wax was removed usually with the fines and wherein wax or substantially no was was present in the final toner product.

Subsequently, there was prepared a developer composition by admixing the aforementioned formulated toner compositions by mechanically mixing in a Littleford M5R blender with current production carrier, described above, at a 5.2 percent toner concentration, that is 5.2 parts by weight of toner per 100 parts by weight of carrier, with a carrier comprised of a steel core with a coating, 0.8 weight percent thereover of a polyvinylidine fluoride and polymethyl methacrylate with carbon black.

A number of the prepared toners were machine tested in a Xerox Corporation DC480, 75 page per minute machine. The first toner that was tested was melt mixed in a Werner and Pfleiderer ZSK-25 Supercompounder with barrel temperature setting of about 130° C. The toner was comprised of 86 percent LEX resin, 4 percent 660P wax, 5 percent FTR-6125F, and 5 percent REGAL 330® carbon black. After particle size reduction and classification, there were added to the toner external additives of 2.8 percent silica dioxide, 2.1 percent titanium dioxide, and 0.24 percent zinc stearate laurate. A developer of 5.2 percent toner and the balance carrier (steel core) was prepared by admixing the aforementioned toner in a Littleford M5R blender. Toner replenisher cartridges were then generated, which cartridges contained the above prepared toner and carrier at a 12:1 ratio, that is 12 parts toner to 1 part carrier, followed by testing in a Xerox Corporation DC480, 75 page per minute machine for about 80,000 copies. This testing spanned a broad range of climates from 65° F. and 10 percent relative humidity to 80° F. and 80 percent relative humidity. Based on machine response to climate changes and tribo/toner concentration latitude, the ability to maintain machine process control was excellent. Process control refers, for example, to the ability of the DC480 machine to retain the toner concentration of from about 3 percent to about 7 percent, and the triboelectric space of from about 14 microcoulombs per gram to about 37 microcoulombs per gram.

A second toner was machine tested as described above with a toner comprised of 82 percent of LEX resin, 5 percent (by weight) 660P wax, 5 percent REGAL 330® carbon black, and 8 percent of FTR-6125F. The components were melt mixed in a Werner and Pfleiderer ZSK-40 supercompounder with at barrel temperature setting of about 140° C. The toner was prepared as illustrated herein and included external additives, replenishers, and developers. The replenishers and developers were prepared as illustrated herein. Approximately 80,000 copies were generated using a Xerox Corporation DC490, a 90 page per minute machine, using the range of climates indicated immediately above with similar results to the control toner with regard to climate changes and toner concentration/tribo response. Performance was judged by the machine's ability to maintain process control.

A third toner was machine tested as illustrated herein, which toner was comprised of 80 percent LEX resin, 5 percent 660P wax, 5 percent REGAL 330® carbon black, and 10 percent FTR-6125F. The components were melt mixed in a Werner and Pfleiderer ZSK-25 supercompounder with a barrel temperature setting of about 140° C. Approximately 20,000 copies were generated in the Xerox Corporation DC480, 75 pages per minute at lab ambient conditions of about 72° F. and 55 percent relative humidity to 74° F. and 42 percent relative humidity. The toner performance was excellent relative to a control toner (no aromatic hydrocarbon) with regard to toner concentration/tribo response, and process control was also excellent and similar to the above second toner.

EXAMPLE II

A toner was prepared by repeating the process of Example I and by mechanically mixing the toner ingredients in a Werner & Pfleiderer ZSK-40 twin screw corotating extruder at barrel set temperatures of about 120° C. to about 130° C. The toner composition differed from Example I in that the resin selected in place of the LEX was crosslinked polyester bisphenol A propylene oxide fumarate polymer with a 37 percent gel/crosslinking value, 4.6 percent R330® carbon black, 4.6 percent of 660P wax, 2.8 percent of AX8840, and the compatibilizer/embrittling agent was comprised of 8 percent by weight of a polymer comprising isopropenyl toluent (IPT) and indene monomers, FMR 0150, available from Mitsui Chemicals of Japan. This polymer was similar to the FTR-6125F also supplied by Mitsui, wherein the indene monomer takes the place of the C4–C5 distillate monomer. The performance characteristics of both polymers are similar. In this present Example, the FMR was added on top of the existing control material formulation that contains a compatibilizer.

The wax dispersion index, determined by the process illustrated in Example I, was 0.04 for this toner, indicating excellent wax dispersion.

| | WAX CONTENT | WDI |
|---|---|---|
| Control Toner | 3.8 | 0.10 |
| 8 weight percent FMR | 4.7 | 0.04 |
| Specification | 4.4 +/− 0.5 | <0.15 |

After pulverization and classification, toner particles with a volume average diameter of about 9 microns as measured by a Coulter Counter were obtained. The addition of FMR-0150 at 8 percent by weight yielded a pulverizing rate increase of about 30 percent relative to the control toner comprised of 87 percent of the polyester, 5 percent R330® carbon black, 5 percent 660P wax, and 3 percent AX8840.

The toner with 8 weight percent FMR, and the above control toner with 0 weight percent FMR were blended with charging additives at 100 parts toner with 2.8 parts colloidal silica, 2.1 parts of a coated colloidal silica (colloidal silicas commercially available; also the coated and other silicas illustrated in U.S. Pat. Nos. 6,190,815 and 6,214,507, the disclosure of which is totally incorporated herein by reference), and 0.24 part of zinc stearate in a high intensity vertical blender. The blended toners were then mixed into a standard developer. Charging was then evaluated by the charge-spectra analysis of developer admix at 0, 15, 30, and 60 seconds. Charge evaluation parameters are Tribo (Q/M), Corrected Wrong Sign (CWS), and Corrected Low Charge (CLC).

A comparison of charge-spectra performance, reference the following table, illustrates substantially similar toner charging, thus there is no adverse charging affects due to the presence of the FMR.

TABLE 3

| | | Developer Admix Charging | |
|---|---|---|---|
| | | 0 PERCENT FMR | 8 PERCENT FMR |
| 0 sec | Q/M | −13.62 | −12.75 |
| | CWC | 0.65 percent | 0.30 percent |
| | CLC | 1.59 percent | 1.21 percent |
| 15 sec | Q/M | −12.02 | −10.98 |
| | CWC | 0.67 percent | 0.23 percent |
| | CLC | 1.93 percent | 1.23 percent |
| 30 sec | Q/M | −12.23 | −11.12 |
| | CWC | 0.50 percent | 0.42 percent |
| | CLC | 2.04 percent | 1.21 percent |
| 60 sec | Q/M | −9.6 | −10.15 |
| | CWC | 0.75 percent | 0.55 percent |
| | CLC | 3.01 percent | 1.49 percent |

Fusing testing of this toner yielded results similar to the control toner. A slight increase of 13° C. in fuser roll temperature rendered the prepared toner substantially equivalent in performance as compared to the control toner with regard to crease specification and stripper finger mark specification.

EXAMPLE III

Several toners comprised of 0 to about 10 percent by weight of the above LEX crosslinked polyester resin, 0 to about 12 percent by weight of the FTR-6125F compatibilizer/embrittling agent available from Mitsui Chemicals of Japan, 16 percent of Blue Flush pigment available from Sun Chemicals of Japan, and RESAPOL linear polyester were generated. The components were mechanically mixed in a Werner & Pfleiderer ZSK-25 SC corotating extruder at barrel set temperatures ranging from about 90° C. to about 120° C. and feed rates ranging from about 40 to about 60 lbs/hour. The pulverizing rate of the above toners was then measured. The amount of FTR-6125F selected can affect the pulverizing rate, with the grinding rate increasing from 0 to about 67 percent.

A designed experiment was used to evaluate the performance of the above toners; considered were 4 factors at 3 levels each, as shown in the following table.

| | LEVEL 1 | LEVEL 2 | LEVEL 3 |
|---|---|---|---|
| Percent Gel | 0 percent | 5 percent | 10 percent |
| Percent E-Agent (6125F) | 0 percent | 6 percent | 12 percent |
| Melt Temp | Below Desired Temperature | Iso-Viscous | Above |
| Barrel Filling | Low | Medium | High |

The performance of the toner were as follows.

| PERCENT GEL | PERCENT FTR | TEMP | GRINDING RATE (LB/HR) |
|---|---|---|---|
| 10 | 0 | Above | 17.1 |
| 5 | 0 | Iso | 17.8 |
| 0 | 0 | Below | 19.1 |
| 0 | 6 | Iso | 24.4 |
| 5 | 6 | Above | 23.1 |
| 10 | 6 | Below | 26.5 |
| 10 | 12 | Iso | 25.3 |
| 5 | 12 | Below | 25.2 |
| 0 | 12 | Above | 28.5 |

A statistical analysis of the above data illustrates that the percent of the FTR 6125F level was responsible for 93 percent of the grind rate. Thus, the addition of FTR compatibilizers increased the fracturability of the toner, which resulted in lower production costs with little or no effect on toner performance when used in the Xerox Corporation DC480 machine.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A toner comprised of resin, colorant, wax, and an aromatic hydrocarbon compatibilizer of a copolymer, and wherein said compatibilizer is generated from a styrene monomer and an indene monomer and possesses a softening point of from about 80° C. to about 100° C.

2. A toner composition in accordance with claim 1 wherein said compatibilizer further functions as an embrittling agent and possesses a low molecular weight, and wherein said wax is retained in said toner.

3. A toner composition in accordance with claim 2 wherein said low molecular weight is from about 1,000 to about 25,000 in weight average molecular weight.

4. A toner composition in accordance with claim 2 wherein said low molecular weight is from about 3,000 to about 15,000 in weight average molecular weight.

5. A toner composition in accordance with claim 2 wherein said low molecular weight is from about 700 to about 2,500 in weight average molecular weight.

6. A toner composition in accordance with claim 1 wherein said compatibilizer possesses a glass transition temperature, Tg of from about 15° C. to about 75° C.

7. A toner composition in accordance with claim 1 wherein said compatibilizer possesses a glass transition temperature, Tg of from about 30° C. to about 60° C.

8. A toner composition in accordance with claim 1 wherein said resin is selected from the group comprised of polyesters, styrene butadiene copolymers, styrene acrylate copolymers, and styrene methacrylate copolymers.

9. A toner composition in accordance with claim 1 wherein there is selected as said resin a polyester, styrene acrylate, or a styrene methacrylate.

10. A developer composition comprised of the toner composition of claim 1, and carrier particles.

11. A developer in accordance with claim 10 wherein the carrier particles are comprised of a core with a polymeric coating thereover.

12. A developer composition in accordance with claim 11 wherein the carrier particles are comprised of a steel or a ferrite core with a coating thereover selected from the group consisting of polychlorotrifluoroethylene-co-vinylchioride copolymer, a polyvinylidene fluoropolymer, a terpolymer of styrene, methacrylate, and an organo silane, fluorinated ethylene-propylene copolymers, and polytetrafluoroethylene.

13. An imaging method which comprises generating an electrostatic latent image on a photoconductive imaging member, subsequently affecting development of this image with the toner composition of claim 1, thereafter transferring the image to a permanent substrate, and optionally permanently affixing the image thereto.

14. A toner composition in accordance with claim 1 wherein said compatibilizer is present in an amount of from about 0.5 to about 10 weight percent.

15. A toner composition in accordance with claim 1 wherein said compatibilizer is present in an amount of from about 0 to about 12 weight percent.

16. A toner composition in accordance with claim 1 wherein said resin is comprised of first and second resin particles, and wherein the first resin particles are selected from the group consisting of polyesters, styrene acrylate copolymers, and styrene methacrylate copolymers.

17. A toner composition in accordance with claim 16 wherein said polyesters result from the condensation reaction of dimethylterephthalate, 1,2-propanediol, 1,3-butanediol, and pentaerythritol; or wherein the polyester results from the condensation reaction of d imethylterephthalate, 1,2-propanediol, diethylene glycol, pentaerythritol, and bisphenol-A with fumaric acid.

18. A toner composition in accordance with claim 16 wherein the first resin particles are present in an amount of from about 40 to about 90 weight percent, and the second resin particles are present in an amount of from about 60 to about 10 weight percent.

19. A toner composition in accordance with claim 16 wherein the first resin is present in an amount of from about 50 weight percent to about 85 weight percent, and the second resin is present in an amount of from about 10 weight percent to about 40 weight percent.

20. A toner composition in accordance with claim 1 wherein the colorant is carbon black.

21. A toner composition in accordance with claim 1 wherein the colorant is a pigment selected from the group consisting of magenta, cyan, yellow, and mixtures thereof.

22. A toner composition in accordance with claim 1 wherein the wax has a weight average molecular weight of from about 1,000 to about 15,000.

23. A toner composition in accordance with claim 1 wherein the wax is a polyolefin, or a mixture of polyolefins.

24. A toner composition in accordance with claim 23 wherein the polyolefin is polyethylene or polypropylene.

25. A toner composition in accordance with claim 1 wherein the wax is a polyolefin, or mixture of polyolefins comprised of polyethylene and polypropylene.

26. A toner composition in accordance with claim 1 wherein the wax is present in an amount of from about 1 to about 10 weight percent, or the wax is present in an amount of from about 2 to about 7 weight percent.

27. A toner composition in accordance with claim 1 wherein said compatibilizer possesses a weight average molecular weight of from about 8° C. to about 2,800.

28. A toner composition in accordance with claim 1 wherein said compatibilizer possesses a weight average molecular weight of from about 790 to about 2,760.

29. A toner composition in accordance with claim 1 wherein said compatibilizer possesses a weight average molecular weight of from about 1,200 to about 1,900.

30. A toner composition in accordance with claim 1 wherein said compatibilizer possesses a number average molecular weight of from about 550 to about 1,600.

31. A toner composition in accordance with claim 1 wherein said compatibilizer possesses a dispersity $M_w/M_n$ of from about 1 to about 2.

32. A toner in accordance with claim 1 containing surface additives.

33. A toner consisting essentially of resin, colorant, wax and a compatibilizer of a copolymer generated from a styrene monomer and an indene monomer, said compatibilizer possessing a softening point of from about 80° C. to about 100° C. , and which compatibilizer contains

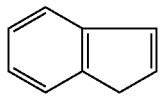

Indene and

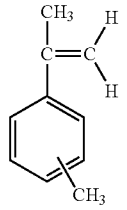

Isopropenyltoluene

.

34. A toner comprised of resin, colorant, wax and a copolymer of isopropenyltoluene/indene, and which copolymer possesses a weight average molecular weight of from about 900 to about 7,000 and a softening point of from about 80° C. to about 100 ° C., and wherein said toner optionally further contains additives of silica oxide, titanium oxide and zinc stearate.

35. A toner in accordance with claim 7 with a glass transition temperature, Tg of from 30° C. to 65° C.

36. A toner composition in accordance with claim 1 wherein said compatibilizer possesses a glass transition temperature, Tg of from about 50° C. to about 65° C.

37. A toner composition in accordance with claim 1 wherein said compatibilizer possesses a number average molecular weight of from about 800 to about 1,100.

38. A toner composition in accordance with claim 1 wherein said compatibilizer possesses a number average molecular weight of from about 920 to about 1,190.

39. A toner composition in accordance with claim 1 wherein said compatibilizer possesses a dispersity $M_w/M_n$ of from about 1.02 to about 1.83.

40. A toner composition in accordance with claim 1 wherein said compatibilizer possesses a dispersity $M_w/M_n$ of from about 1.40 to about 1.70.

41. A toner composition in accordance with claim 34 wherein said copolymer of isopropenyttoluene/indene possesses a weight average molecular weight of from about 1000 to about 4000.

42. A toner composition in accordance with claim 34 wherein said copolymer of isopropenyltoluene/indene possesses a weight average molecular weight of from about 2000 to about 6000.

43. A toner composition in accordance with claim 33 wherein said compatibilizer is a copolymer of isopropenyltoluene/indene.

* * * * *